US010364644B2

(12) United States Patent
Zhou

(10) Patent No.: US 10,364,644 B2
(45) Date of Patent: Jul. 30, 2019

(54) STAGE CEMENTING TOOL

(71) Applicant: Saudi Arabian Oil Company, Dhahran (SA)

(72) Inventor: Shaohua Zhou, Dhahran (SA)

(73) Assignee: Saudi Arabian Oil Company (SA)

( * ) Notice: Subject to any disclaimer, the term of this patent is extended or adjusted under 35 U.S.C. 154(b) by 289 days.

(21) Appl. No.: 15/258,575

(22) Filed: Sep. 7, 2016

(65) Prior Publication Data

US 2018/0066497 A1 Mar. 8, 2018

(51) Int. Cl.

| | |
|---|---|
| ***E21B 33/13*** | (2006.01) |
| ***E21B 33/14*** | (2006.01) |
| ***E21B 23/03*** | (2006.01) |
| ***E21B 34/10*** | (2006.01) |
| ***E21B 7/20*** | (2006.01) |
| ***E21B 10/00*** | (2006.01) |
| *E21B 34/00* | (2006.01) |

(52) U.S. Cl.

CPC ..... *E21B 33/146* (2013.01); *E21B 7/20* (2013.01); *E21B 10/00* (2013.01); *E21B 23/03* (2013.01); *E21B 33/13* (2013.01); *E21B 34/102* (2013.01); *E21B 2034/007* (2013.01)

(58) Field of Classification Search

CPC ..... E21B 33/14; E21B 33/146; E21B 7/20; E21B 10/00; E21B 23/03; E21B 34/102; E21B 2034/007

See application file for complete search history.

(56) References Cited

U.S. PATENT DOCUMENTS

| | | | | |
|---|---|---|---|---|
| 1,944,442 A * | 1/1934 | Manning | ..... | E21B 33/134 166/142 |
| 3,948,322 A | 4/1976 | Baker | | |
| 4,176,717 A | 12/1979 | Hix | | |
| 4,312,406 A | 1/1982 | McLaurin et al. | | |
| 4,319,638 A * | 3/1982 | Baker | ..... | E21B 33/124 166/129 |

(Continued)

FOREIGN PATENT DOCUMENTS

| | | | |
|---|---|---|---|
| SU | 541020 A1 * | 12/1976 | ..... E21B 33/146 |
| SU | 541020 A1 | 12/1976 | |

OTHER PUBLICATIONS

International Search Report and Written Opinion for related PCT application PCT/US2017/047959 dated Nov. 30, 2017.

*Primary Examiner* — Zakiya W Bates
*Assistant Examiner* — Crystal J Miller
(74) *Attorney, Agent, or Firm* — Bracewell LLP; Constance Gall Rhebergen

(57) ABSTRACT

A system for cementing a tubular in a wellbore that includes a sleeve made up of an annular housing with a cement seal on outer surface of the housing. The sleeve further includes a sliding block, a stationary block, an arm attached to the sliding block, and a passage formed through a sidewall of the housing, and that receives a free end of the arm. When the sleeve inner bore is pressurized, the arm moves to move the sliding block into an open space in the stationary block. Inserting the sliding block into the open space forms a seal on the outer periphery of the sleeve which forms a barrier to cement flowing in an annulus between the sleeve and inner surface of the wellbore. Lost circulation material can be deposited in the annulus and which settles along an interface between the seal and wellbore wall.

20 Claims, 12 Drawing Sheets

(56) References Cited

U.S. PATENT DOCUMENTS

| | | | | |
|---|---|---|---|---|
| 4,520,870 | A | 6/1985 | Pringle | |
| 4,648,448 | A * | 3/1987 | Sanford | E21B 23/006 166/187 |
| 8,215,404 | B2 | 7/2012 | Makowiecki et al. | |
| 8,342,243 | B2 | 1/2013 | Esmail | |
| 8,955,603 | B2 | 2/2015 | Ravensbergen et al. | |
| 2004/0031610 | A1 | 2/2004 | Schultz et al. | |
| 2012/0125629 | A1 | 5/2012 | Churchill | |
| 2012/0261127 | A1 * | 10/2012 | Zhou | E21B 21/103 166/289 |
| 2013/0161004 | A1 | 6/2013 | Zhou | |
| 2016/0208577 | A1 | 7/2016 | Byberg et al. | |

* cited by examiner

FIG. 6C
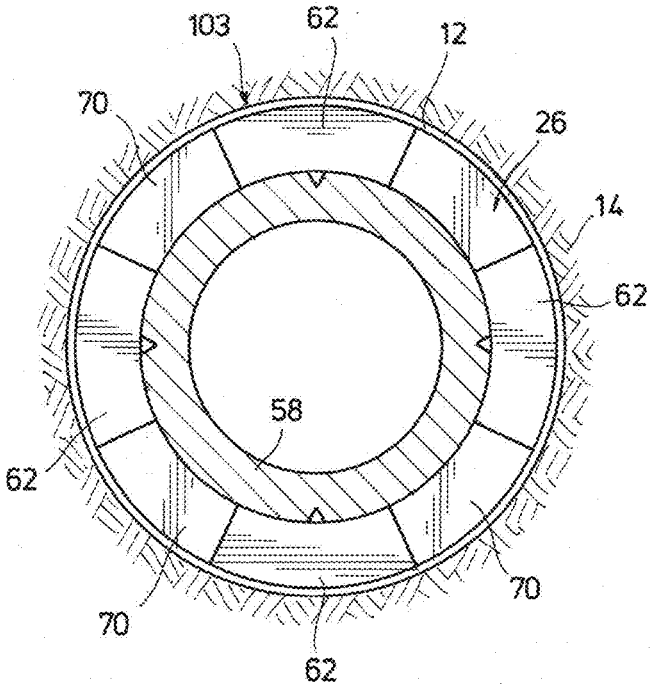
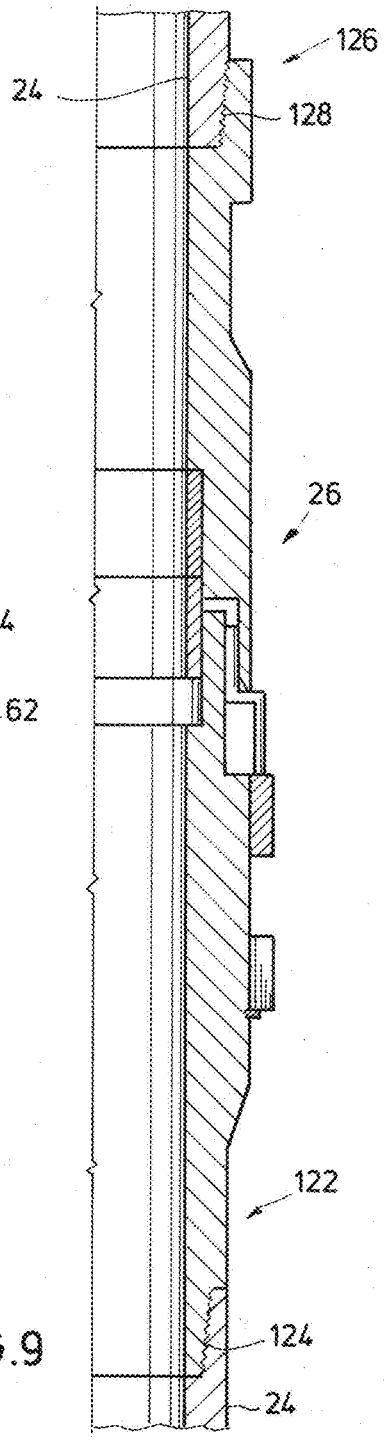
FIG. 9

STAGE CEMENTING TOOL

BACKGROUND OF THE INVENTION

1. Field of Invention

The present disclosure relates to a cementing tool having a seal on an outer surface that is formed by selectively aligning seal members along a circumference of the tool.

2. Description of Prior Art

Hydrocarbons that are produced from subterranean formations typically flow from the formation to surface via wellbores that are drilled from surface and intersect the formation; where casing often lines the wellbores. The casing is usually bonded to the inner surface of the wellbore with a cement that is injected into an annulus that is between the casing and wellbore. In addition to anchoring the casing within the wellbore, the cement also isolates adjacent zones within the formation from one another. Zonal isolation is especially useful when adjacent zones have different types of entrained fluids, i.e. oil or gas hydrocarbon versus non-hydrocarbon water. Without the cement isolating these adjacent zones, the different fluids could become mixed, which requires subsequent separation, or can reduce the hydrocarbon producing potential of the wellbore. The cement also prevents hydrocarbon fluid from flowing uphole from a hydrocarbon producing zone and to the surface. Without the cement, or in instances when cement has failed, hydrocarbons are known to migrate to surface.

A common method for injecting the cement into the annulus between the casing and wellbore sidewall involves pumping cement inside the casing, and then forcing the cement to the casing bottom, where the cement then flows back up into the annulus. How much cement is injected is estimated based on the annulus volume in which the cement is being injected. To force the cement upward in the annulus, a plug is landed on top of the cement column, and pressurized fluid is injected into the casing to push the plug downward inside the casing. A cement shoe is often provided at the lowermost end of the casing, and which the plug latches to when it reaches the casing bottom. The plug prevents the cement from flowing from the annulus and into the casing. In some deep wells, such as those exceeding 15,000 feet in depth, surface pressures required to force the cement up the entire annulus, particularly with a very heavy cement slurry, may exceed what is possible or practical to handle without risking the failure of surface or downhole equipment. Also, some wellbores have sections that cannot withstand the hydrostatic pressures necessary to displace a single column of cement in the annulus, and can allow an out-flux of fluid when subjected to these pressures—a condition commonly referred to as lost circulation. To avoid these high pressure problems, cement is sometimes injected in stages into axial sections of the annulus.

SUMMARY OF THE INVENTION

Described herein is an example of a system for use with operations in a wellbore that includes a cementing sleeve having axial ends that selectively attach to tubulars, a stationary block mounted to an outer surface of the cementing sleeve and that circumscribes a portion of an outer periphery of the cementing sleeve, a space on the outer periphery of the cementing sleeve that is defined between circumferential ends of the stationary block, a sliding block on the outer surface of the cementing sleeve and that is selectively moveable into the space from a location spaced axially away from the space to substantially fill the space and form a seal (or a physical barrier) along the outer periphery of the cementing sleeve. The system can further include a passage formed radially through the cementing sleeve and that is in selective communication with the outer surface of the cementing sleeve when the sliding block is moved into the space. This example can also further include an opening sleeve on an inner surface of the sleeve and that is axially moveable from an interfering position adjacent where the passage intersects with an inner surface of the cementing sleeve to an open position that is axially set away from where the passage intersects with the inner surface, so that fluid inside of the cementing sleeve is in communication to the outer surface of the cementing sleeve through the passage. Further optionally included is a closing sleeve that is axially moveable from a position adjacent the opening sleeve when the opening sleeve is in the interfering position, to a closing position that is adjacent the passage intersects with the inner surface of the cementing sleeve. The tubulars can be wellbore casing, and wherein the combination of the wellbore casing and cementing sleeve makes up a wellbore string. A drill bit can be selectively attached to the wellbore string and that is used to form the wellbore. Optionally included with the system is an elongated arm attached to the sliding block and having an end inserted into a portion of the passage adjacent an outer surface of the cementing sleeve, so that when pressure inside of the cementing sleeve is increased, a force from the increased pressure is exerted onto the end of the arm in the passage to move the arm and the sliding block into the space. In an example, the elongated arm includes a lower section, a middle section, and an upper section, wherein the lower section attaches to the sliding block and the upper section inserts into the passage, wherein the middle section joins the upper and lower sections, wherein the upper and lower sections extend generally parallel with an axis of the cementing sleeve, and wherein the middle section extends generally perpendicular to the axis of the cementing sleeve. The system can further include a multiplicity of stationary blocks, a multiplicity of spaces between the stationary blocks, and a multiplicity of sliding blocks that selectively slide into the spaces. In one example the system has a multiplicity of cementing sleeves.

Also described herein is a method of performing operations in a wellbore which includes aligning blocks along an outer circumference of a cementing sleeve in the wellbore to form a seal between the cementing sleeve and an inner surface of the wellbore, supplying wellbore cement into a bore of the cementing sleeve, and diverting the cement from the bore into the annulus and adjacent the seal, so that the cement flows in the annulus in a direction away from the seal. The cementing sleeve can have opposing axial ends attached to wellbore casing, wherein the cementing sleeve and wellbore casing define a casing string. The method can further include inserting the casing string into the wellbore and rotating the casing string in the wellbore. In an embodiment, a drill bit is provided on an end of the casing string and the wellbore can be formed by rotating the drill bit and casing string. In an example, the cementing sleeve is a first cementing sleeve, and the steps of aligning blocks, supplying cement, and diverting the cement into the annulus can be repeated with a second cementing sleeve that is at a depth in the wellbore that is different than a depth of the first cementing sleeve. A space between an outer periphery of the seal and the inner surface of the wellbore can be filled by providing lost circulation material into the bore and diverting the lost circulation material into the annulus. In an embodiment, the blocks include sliding blocks and stationary blocks, wherein spaces are defined between ends of the stationary blocks that face an adjacent stationary block, and wherein arms are attached to the sliding blocks that have ends selectively insertable into passages that penetrate through sidewalls of the cementing sleeve. Aligning the blocks can be done by increasing a pressure in the bore so that a force applied to the arms urges the arms axially along an outer surface of the cementing sleeve and pushes the sliding blocks into the spaces. Opening and closing sleeves disposed coaxially inside the bore can be moved to selectively control fluid communication between the bore and outer surface of the cementing sleeve. The opening and closing sleeves can be moved by engaging the opening and closing sleeves with a tubing string and axially moving the tubing string inside of the bore.

BRIEF DESCRIPTION OF DRAWINGS

Some of the features and benefits of the present invention having been stated, others will become apparent as the description proceeds when taken in conjunction with the accompanying drawings, in which:

FIG. 6C is an axial sectional view of an example of the cement sleeve of FIG. 4B and taken along lines 6C-6C.

FIG. 9 is a side sectional view of an example of the cement sleeve of FIG. 4A and having box and pin ends.

Figure 1:
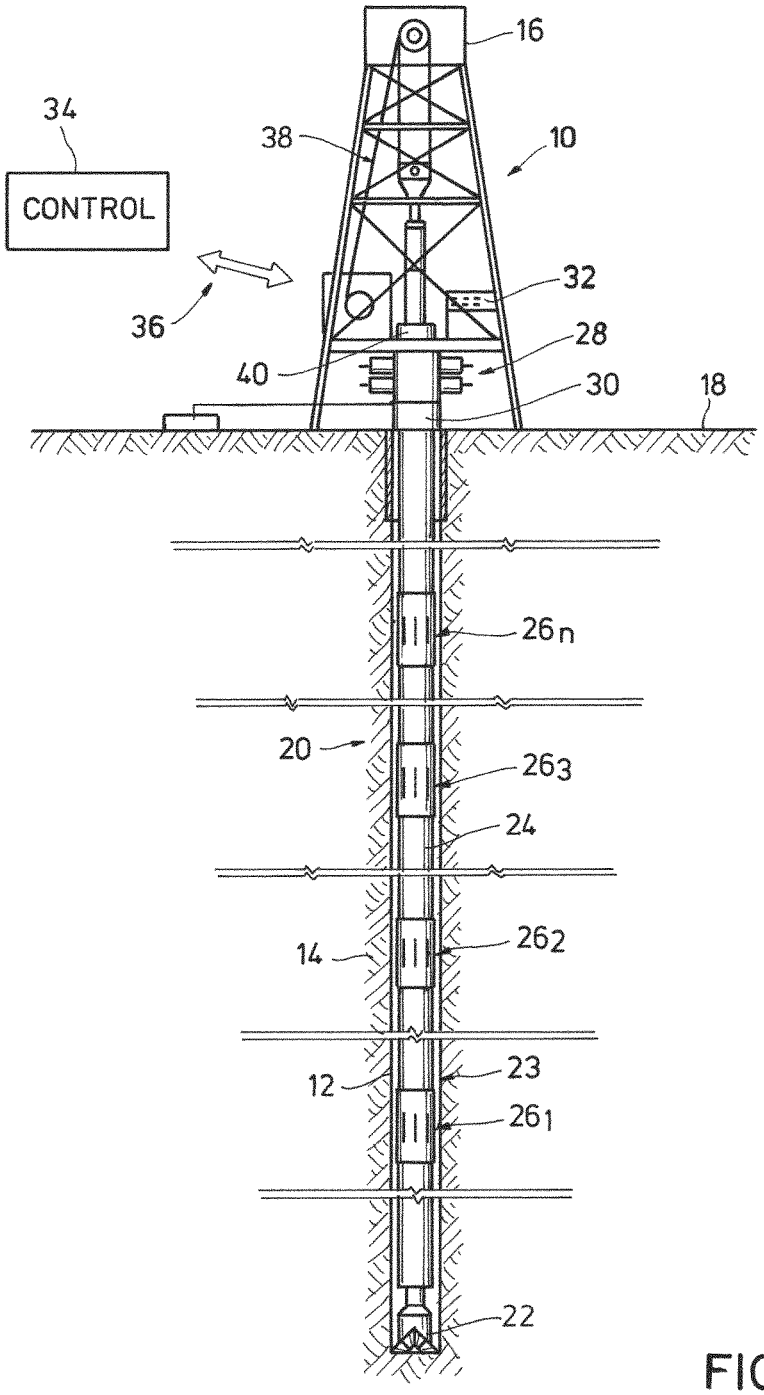
FIG. 1 is a side sectional view of an example of a system for casing drilling and completing a wellbore

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows in a side partial sectional view one example of a system 10 for forming and completing a wellbore 12. As shown, wellbore 12 extends vertically through a subterranean formation 14 and is used for extracting hydrocarbons from the formation 14. Included with the system 10 is a derrick 16 that is mounted on surface 18 and over an opening of wellbore 12. In the example of FIG. 1, wellbore 12 is being formed by a drill string 20, where the drill string 20 includes a drill bit 22 attached to a lower end of a casing string 23. Casing string 23 includes segments of casing 24 and cementing sleeves $\mathbf{26}_{1\text{-}n}$ disposed in series with the segments of casing 24. As explained in more detail below, the cementing sleeves 26 provide the means for cementing the casing string 23 to the wellbore 12.

Further included with the example system 10 is a blowout preventer 28 on surface and which is mounted to a wellhead assembly 30 that covers the opening of wellbore 12. Optionally included with system 10 is a driller console 32 on a floor of the derrick 16. A controller 34 is schematically represented that is in communication with system 10 via a communication means 36. The controller 34 can be mounted on the derrick 16 or remote from system 10, wherein the communication means 36 can be wired or wireless. Also optionally illustrated in the system 10 are draw works 38, which include a system of cables and pulleys for hoisting and lowering various equipment that is either inserted into the wellbore 12 or are used in conjunction with forming or completing wellbore 12. Further in the example of FIG. 1, a rotary table 40 is illustrated on the derrick 16 and can be used for rotating the drill string 20. Optionally, a top drive (not shown) can be suspended from draw works 38 and used for rotating the drill string 20.

Figure 2:
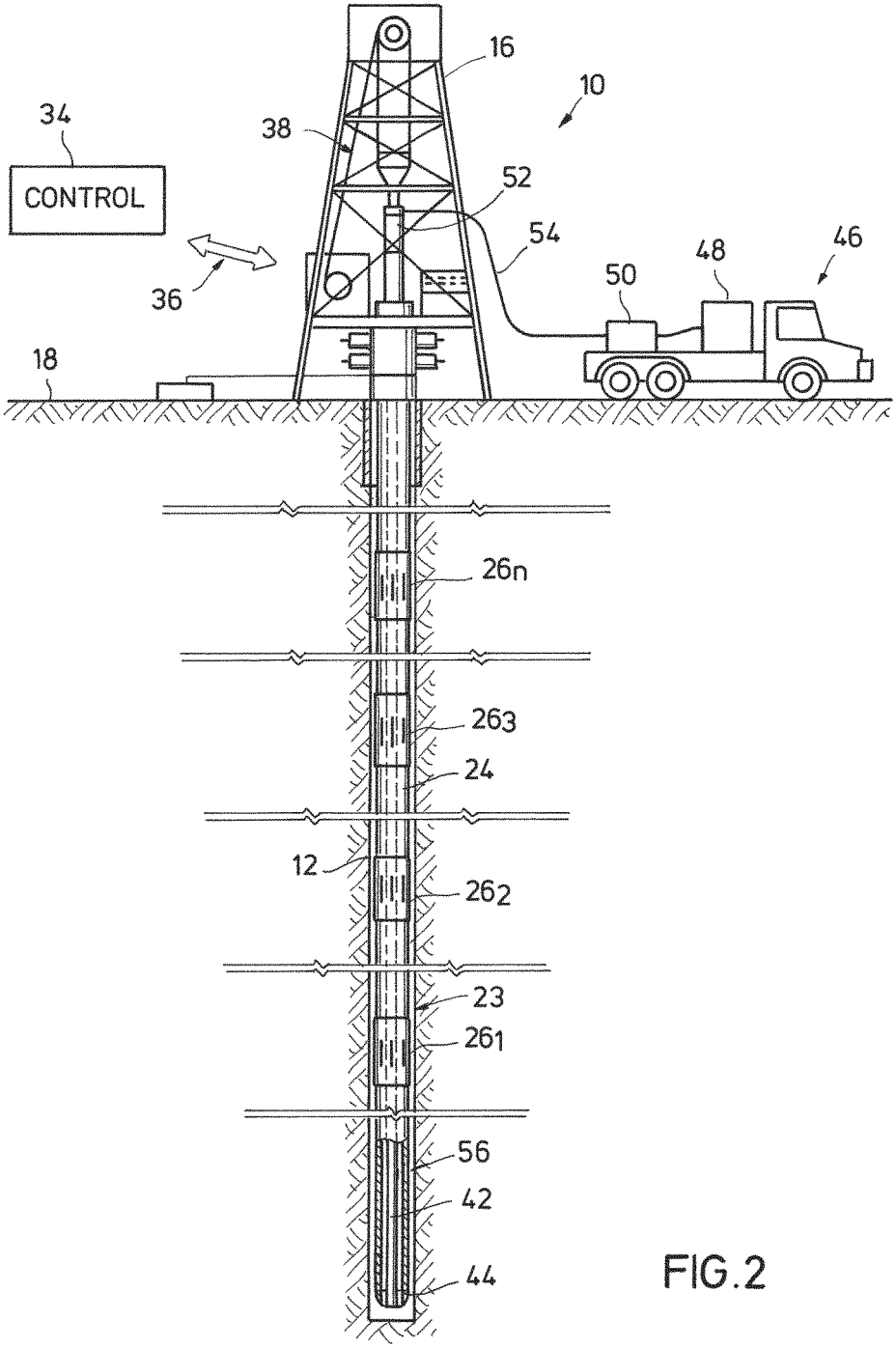
FIGS. 2 and 3 are side sectional views of examples of the system of FIG. 1 during stage cement procedures.

Shown in FIG. 2 is an example embodiment of system 10 that is used for introducing cement into the wellbore 12 and where an annular tubing string 42 is inserted within the casing string 23. A lower end of tubing string 42 inserts into a float shoe 44 that is formed on a lowermost end of the casing string 23. In the example of FIG. 2 the drill bit 22 is not illustrated for simplicity. It is within the capabilities of those skilled in the art to consider that the bit 22 can be a suitable and drillable PDC bit and installed with the float shoe 44 added to the casing string 23. A cement truck 46 is provided on surface in which includes a tank 48 for storing cement. Also shown is a pump 50 that receives the cement from a line attached to the tank 48, and pressurizes the cement to form a pressurized cement slurry that is delivered into the wellbore 12. Pressurized cement slurry flows to a cement head 52 shown mounted above the rig floor and within derrick 16 via a cement line 54 that connects a discharge end of pump 50 into the cement head 52. The cement head 52 is in fluid communication with the tubing string 42, thus the pressurized cement slurry flows down in through tubing string 42 into wellbore 12. After exiting the tubing string 42, the cement slurry flows upward within an annulus 56 that is defined in the space between an outer surface of casing string 23 and inner surface of wellbore 12. In the example of FIG. 2, the portion of the casing string 23 being cemented within wellbore 12 is limited to that that is below cementing sleeves $\mathbf{26}_{1-n}$.

Figure 3:
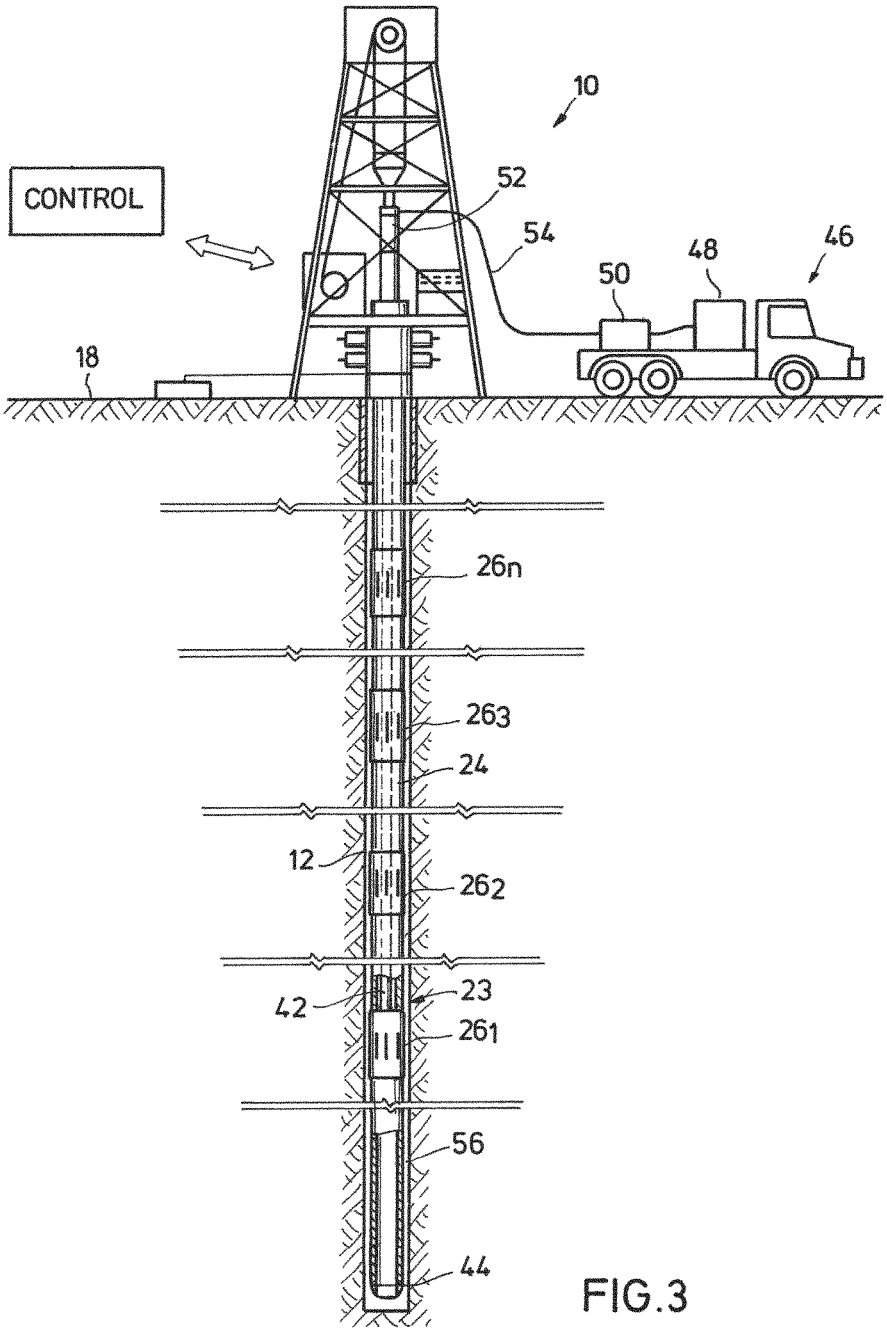

FIG. 3 illustrates an example of a next step in cementing wellbore 12 wherein the tubing string 42 has been pulled upward and away from the float shoe 44 and is adjacent the cementing sleeve $\mathbf{26}_1$. However, the discharge end of tubing string 42 can be moved at other places or depths within the casing 24 and adjacent to the other cementing sleeves $\mathbf{26}_{2-n}$.

Figure 4A:
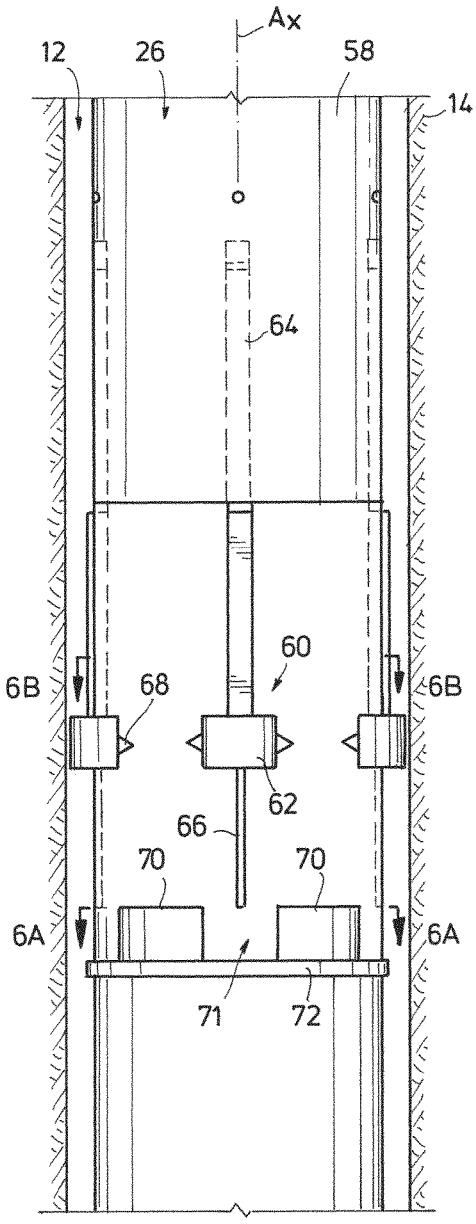
FIG. 4A is a side view of an example of a cement sleeve for use with the system of FIG. 1 and in a non-sealing configuration.

Referring now to FIG. 4A, an example of a cementing sleeve 26 is shown in a side view. Here, cementing sleeve 26 is shown made up of an annular housing 58 and sliding block assemblies 60 mounted on an outer surface of housing 58 at spaced apart angular locations around the axis $A_X$ of sleeve 26. The sliding block assemblies 60 include sliding blocks 62 which have a generally rectangular cross-section when viewed along a path that circumscribes sleeve 26. The sliding blocks 62 are arcuate along their lengths that each extend along a portion of the circumference of housing 58. Each of the sliding blocks 62 is shown having an attached elongate block arm 64, where the arms 64 each extend substantially parallel with an axis $A_X$ of the housing 58. Blocks 62 are slidable within tracks 66 which are depressions formed along the outer surface of housing 58 and extend in generally axial directions. The tracks 66 are spaced apart angularly from one another and can be at equidistant spacing around the circumference of the housing 58. Retainers 68 are optionally provided on the outer surface of the housing 58 and adjacent the lateral sides of each of the sliding blocks 62. The retainers 68 are strategically positioned to resist movement of the sliding blocks 62 in a direction along the circumference of housing 58. Further shown in the example of FIG. 4A are stationary blocks 70 which are angularly offset from sliding blocks 62 and disposed at a position axially away from the circumferential path where the sliding blocks 62 of FIG. 4A are located. Angularly spacing apart the stationary blocks 70 defines spaces 71 or slots between the stationary blocks 70. In the example of FIG. 4A, a stop ring 72 is shown which projects radially outward from the outer surface of housing 58 and circumscribes the housing 58 at an axial location adjacent the axial ends of the stationary blocks 70 on a side opposite of the sliding blocks 62. A configuration of the cementing sleeve 26 of FIG. 4A is set so that when the casing string 23 (FIG. 1) is being inserted into the wellbore 12 while a fluid is within the annulus 56, the fluid can easily flow by and past the blocks 62, 70. Moreover, the strategic dimensioning of the blocks 62, 70 allows the casing string 23 to rotate inside the wellbore 12 while circulating fluid from surface.

Figure 5B:
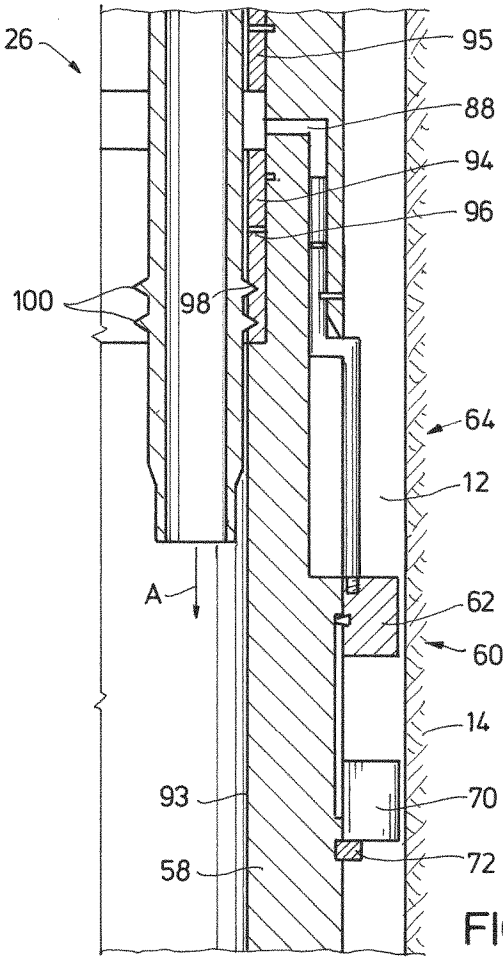
FIGS. 5A-5E are sectional views of an example of the cement sleeve of FIGS. 4A and 4B and during a stage cementing operation.
Figure 5A:
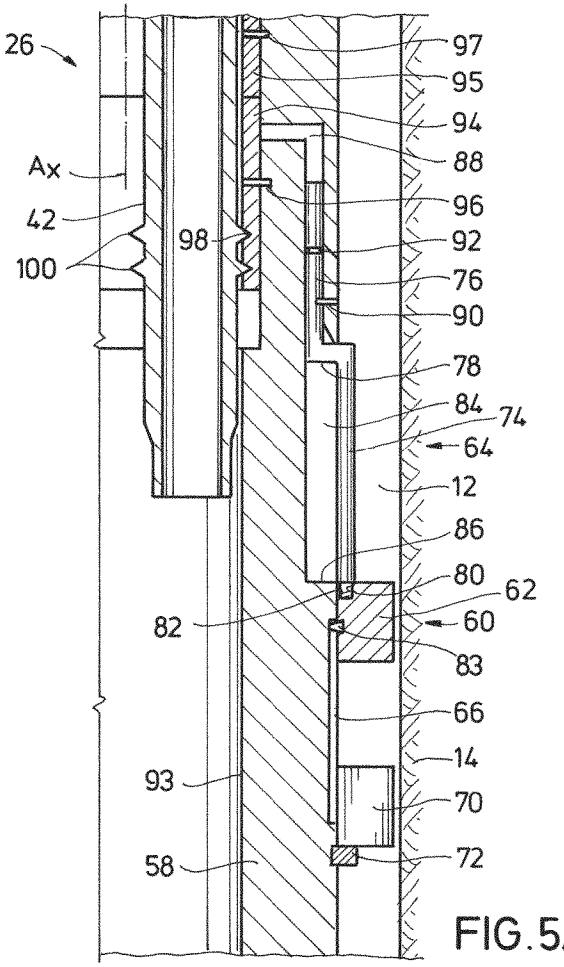

FIG. 5A shows in a side sectional view an example of cementing sleeve 26 where the block arms 64 are shown having a lower section 74, an upper section 76, and a middle section 78 which connects the upper and lower sections 74, 76. Lower section 74 has a threaded tip 80 which threadingly couples into a threaded bore 82 formed into an upper surface of the block 62. Additionally, an inner side of sliding block 62 facing housing 58 is equipped with a guide pin 83 that projects in a radially inward direction and into the tract 66, so that sliding block 62 can be moved along a designated path axially along the outer surface of housing 58. Further illustrated is that the upper and lower sections 74, 78 extend generally parallel with the axis $A_X$ of sleeve 26, whereas the middle section 78 projects radially from axis $A_X$. To accommodate the offset configuration of the arm 64 introduced by the middle section 78 a recess 84 is shown on the outer surface of housing 58 that extends an axial length that is roughly equal to an axial length of the lower section 74. Lower terminal end of recess 84 defines an upward-facing shoulder 86 that extends in a radial direction from bottom of recess 84 up to an outer surface of housing 58. Further shown in FIG. 5A is a passage 88 that projects radially outward from an inner surface of the housing 58, and transitions to a path that is generally parallel with the axis $A_X$ and terminates in the recess 84. A shear pin 90 intersects the upper section 76 of arm 64 and has a portion within an opening in the housing 58, thereby selectively securing arm 64 to housing 58. Arm 64 is further equipped with a seal 92, shown as an O-ring, that circumscribes the outer periphery of the upper section 76 and disposed within passage 88. Seal 92 provides a sealing interface in the space between upper section 76 and passage 88. The tubing string 42 is illustrated disposed in a bore 93 that axially intersects housing 58. Tubing string 42 is adjacent an opening sleeve 94 which is a ring-like member that inserts coaxially within bore 93 and has an outer surface in contact with an inner surface of bore 93. In the configuration illustrated in FIG. 5A, the opening sleeve 94 is adjacent passage 88 thereby blocking communication between passage 88 and bore 93. A closing sleeve 95 is shown axially adjacent opening sleeve 94, and wherein closing sleeve 95 also circumscribes bore 93 and is in contact with the inner surface of housing 58. Shear pins 96, 97 respectively retain the sleeves 94, 95 in the positions shown in FIG. 5A. Opening sleeve 94 is shown having indentations 98 on its inner surface that can extend fully along the inner circumference of opening sleeve 94 or a portion thereof. Complementary protrusions 100 are provided on the outer surface of tubing string 42 and thereby allowing tubing string 42 to engage opening sleeve 94. In the example of FIG. 5A, protrusions 100 fully circumscribe the outer surface of tubing 42, but examples exist wherein the protrusions 100 extend only along portions of the outer surface of tubing 42.

Figure 5D:
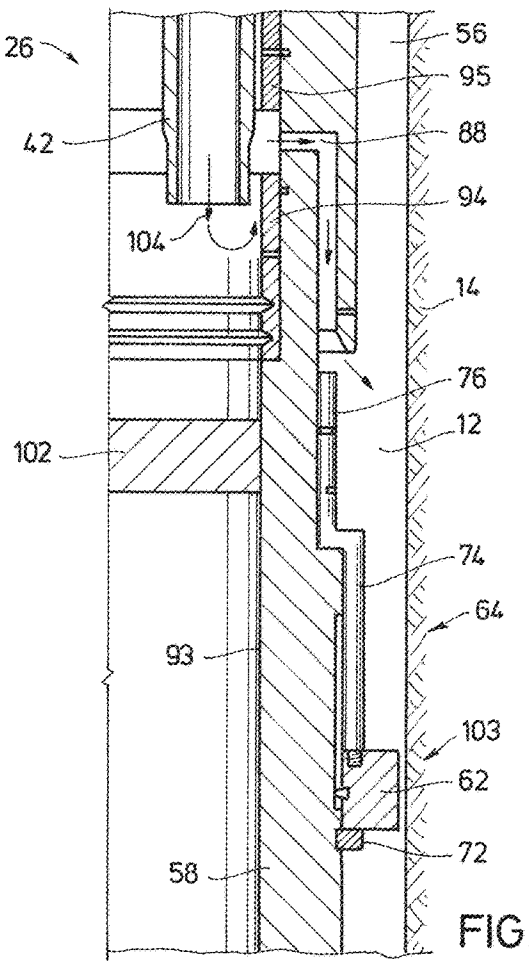
Figure 5C:
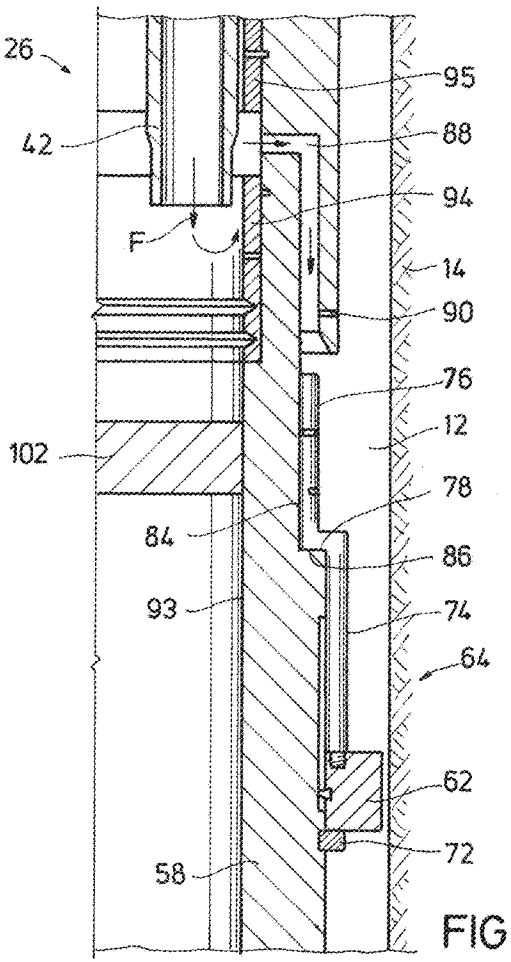

Referring now to FIG. 5B, tubing string 42 has been moved axially downward as illustrated by arrow A and with the protrusions 100 engaged with the indentations 98, applying sufficient force onto opening sleeve 94 to shear the shear pin 96 so that opening sleeve 94 is axially movable within the housing 58. Axially moving the opening sleeve 94 within sleeve 26 as shown allows communication between bore 93 and 88. FIG. 5C illustrates in side sectional view a next step of a cementing process wherein fluid F is introduced from tubing string 42 and into bore 93 and which makes its way into passage 88. The fluid F is at a pressure sufficient to apply force onto a tip of the upper section of arm 64 in an axial direction and push arm 64 out of the passage 88 that in turn moves sliding block to a position adjacent the stationary block 70 (FIG. 5A). Stop ring 72 provides a backstop to prevent additional movement of sliding block 62 and which also ensures an axial alignment of sliding blocks 62 with stationary blocks 70. Further shown in FIG. 5C is the introduction of a plug 102 within bore 93 that prevents fluid F from flowing within bore past the cementing sleeve 26 so that the fluid F is diverted into passage 88. It is within the capabilities of those skilled in the art in order to provide a plug 102 that can serve to block the flow of fluid F within bore 93. For example, the flow of fluid F can be diverted by disposing a viscous pill downhole via the tubing string 42, and which can act as a plug.

Figure 4B:
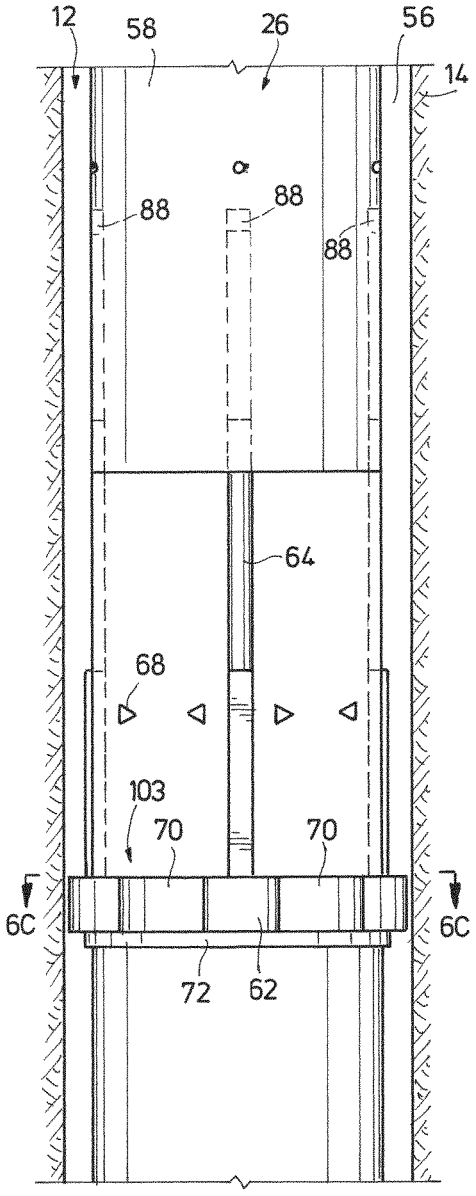
FIG. 4B is a side view of an example of a cement sleeve for use with the system of FIG. 1 and in a sealing configuration.

Referring now to FIG. 4B, shown in side view is an example of the sliding blocks 62 having been moved into the spaces 71 (FIG. 4A) and adjacent the stationary blocks 70. The sliding blocks 62 and stationary blocks 70 circumferentially align at an axial position to form a ring that circumscribes the housing 58 to define a cement seal 103 around the housing 58. The cement seal 103 projects radially outward from housing 58 into annulus 56 and forms a barrier in the annulus 56. Further illustrated in FIG. 4B is how the passages 88 are open to communication with an outer surface of the housing 58 through which fluid within bore 93 (FIG. 5C) can make its way to the annulus 56 between the sleeve 26 and inner surface of wellbore 12. Referring now to FIG. 5D, after the arm 64 and sliding blocks 62 have been moved adjacent to the stationary blocks 70, cement 104 can be injected into bore 93, and by virtue of the plug 102 the cement 104 is diverted into passage 88 and into the annulus 56. The strategic positioning of the blocks 62, 70 now form a cement seal 103 which blocks the flow of cement in the annulus 56 across the cement seal 103 so that the cement 104 remains on a side of the cement seal 103 facing passage 88.

Figure 5E:
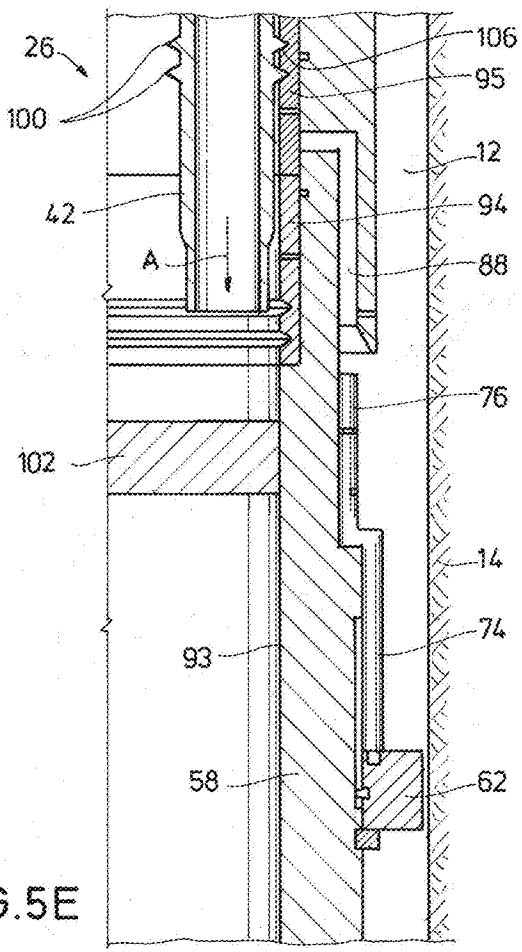

In one example of operation, after cementing, and as shown in the example of FIG. 5E, protrusions 100 on the tubing string 42 engage indentations 106 shown formed along an inner circumference of the closing ring 95. An axial force is applied to tubing string 42 in a direction as shown by arrow A, which in turn exerts a force to closing sleeve 95 exceeding a strength of its shear pin 97 (FIG. 5A) thereby fracturing shear pin 97. By removing the resistance of the shear pin 97, an continuing to apply a force to tubing string 42 in the direction of arrow A, and the closing sleeve 95 is axially urged to a location that it is adjacent to where passage 88 intersects with bore 93. Positioning the closing sleeve 95 as shown in FIG. 5E forms a flow barrier between bore 93 and passage 88 that blocks fluid from within bore 93 from flowing into passage 88.

Figure 6A:
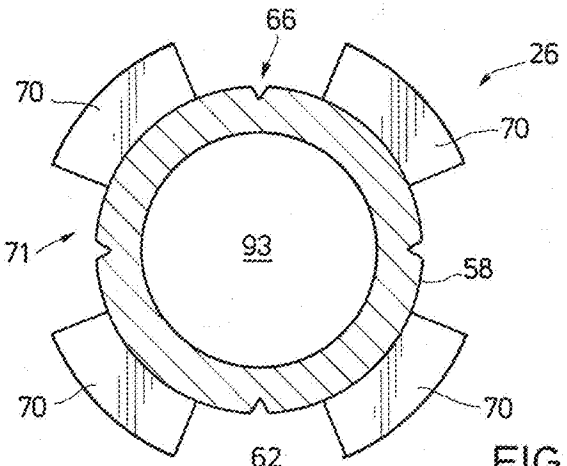
FIG. 6A is an axial sectional view of an example of the cement sleeve of FIG. 4A and taken along lines 6A-6A.

FIG. 6A is an axial sectional view of a portion of cementing sleeve 26 and taken along lines 6A-6A of FIG. 4A. In this example, the stationary blocks 70 can be seen projecting radially outward from housing 58 and at generally angularly spaced apart locations from one another thereby leaving open spaces 71 between their lateral ends and that face adjacent stationary blocks 70. Further illustrated are the tracks 66 that extend axially along the outer surface of housing 58 and between the stationary blocks 70.

Figure 6B:
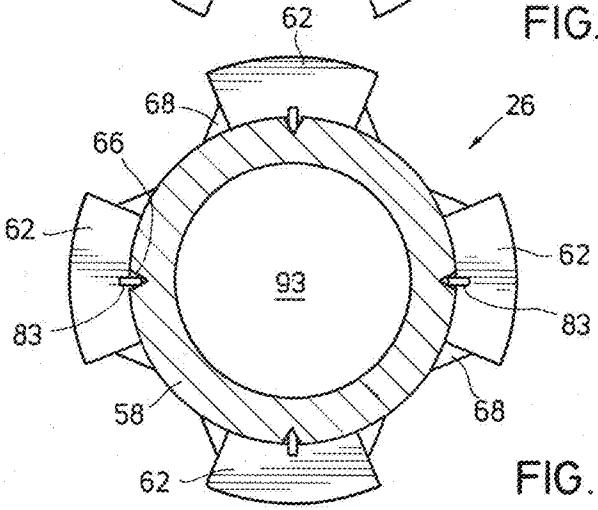
FIG. 6B is an axial sectional view of an example of the cement sleeve of FIG. 4A and taken along lines 6B-6B.

FIG. 6B shows in axial sectional view of the cementing sleeve 26 taken along lines 6B-6B of FIG. 4A. Here, the sliding blocks 62 are shown in the deploying configuration, that is spaced axially apart from the stationary blocks 70. Because the sliding blocks 62 are spaced axially from the stationary blocks 70 in the deploying configuration, the cementing seal 103 is not yet formed, which allows fluid flow axially in the annulus 56 (FIG. 4A) and past or by-pass the blocks 62, 70 as the casing string 23 is being inserted into the wellbore 12 (FIG. 2). In the example of FIG. 6B, like the stationary blocks 70 of FIG. 6A, the sliding blocks 62 are spaced angularly apart from one another around the circumference of housing 58. Further in the example of FIG. 6B, the retainers 68 are shown having triangular cross-sections and set adjacent the sliding blocks 62 to prevent the blocks 62 from moving to different angular positions around the housing 58. Guide pins 83 also are shown projecting radially into the tracks 66, so that the sliding blocks 62 can travel along the designated axial path and into the spaces 71 of FIG. 6A. FIG. 6C illustrates an example of the cement seal 103 and taken along lines 6C-6C of FIG. 4B. Here, the sliding blocks 62 are aligned axially with the stationary blocks 70 to form the cement seal 103 that fully circumscribes housing 58 thereby blocking a flow of cement through annulus 56.

Figure 7A:
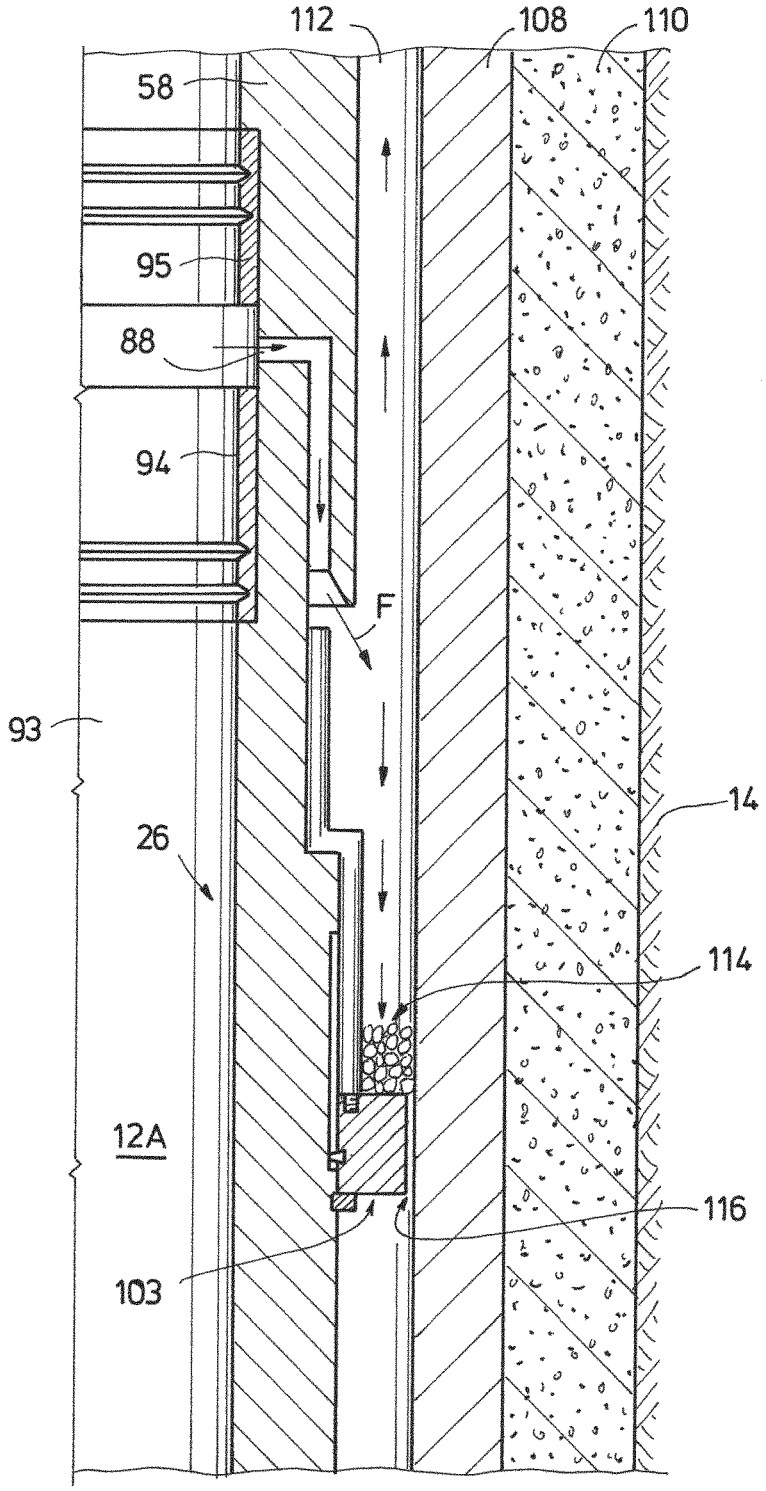
FIGS. 7A and 7B are side sectional views of an example of a stage cementing sequence using the cement sleeve of FIG. 4A and within casing.
Figure 7B:
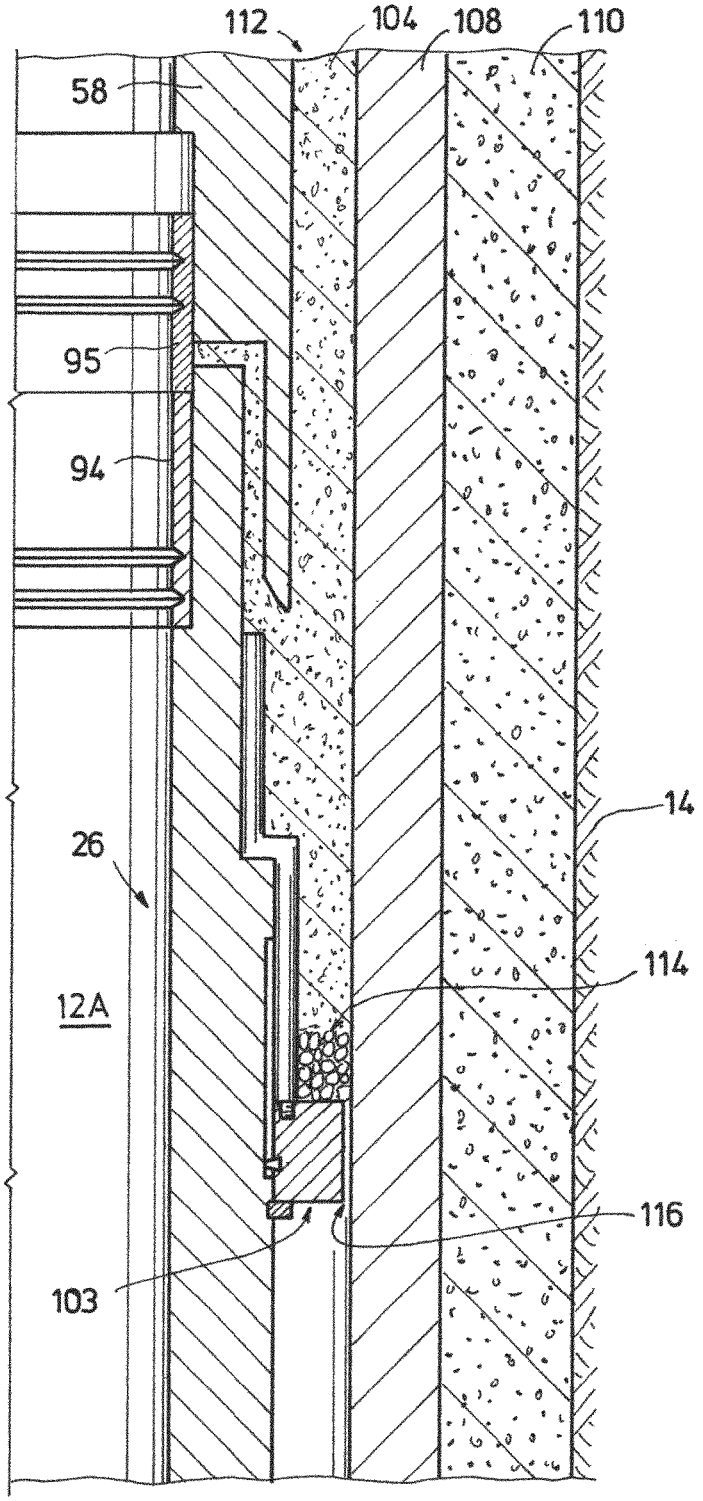

FIGS. 7A and 7B show side axial views of an alternate embodiment of cementing between the housing 58 where an outer casing 108 is shown cemented within wellbore 14, and where a layer of cement 110 bonds the outer casing 108 to formation 14. Here an annulus 112 is formed between an outer surface of housing 58 and an inner surface of casing 108. Further shown is an amount of lost circulation material 114 that has collected on a side of seal 103 facing passage 88 and that fills any gaps 116 that may be present between the outer circumference of cement seal 103 and inner surface of outer casing 108. The lost circulation material 114 can be injected with the fluid F, and which falls out of the fluid F as the fluid F enters the annulus 112 after exiting the passage 88. Thus, as shown in FIG. 7B, when cement 104 is introduced through passage 88 into annulus 112, the lost circulation material 114 stops the cement 104 from leaking through the gap 116 between an outer radial surface of seal 103 and inner surface of casing 108. The lost circulation material 114 can be fibrous or have a plate like structure, and can be made from ground shells such as from peanuts, walnuts, or cottonseed. Other example materials for the lost circulation material can be polymers, rubber, fibers of cellulose, mica, calcium carbonate, like materials, and combinations thereof.

Figure 8A:
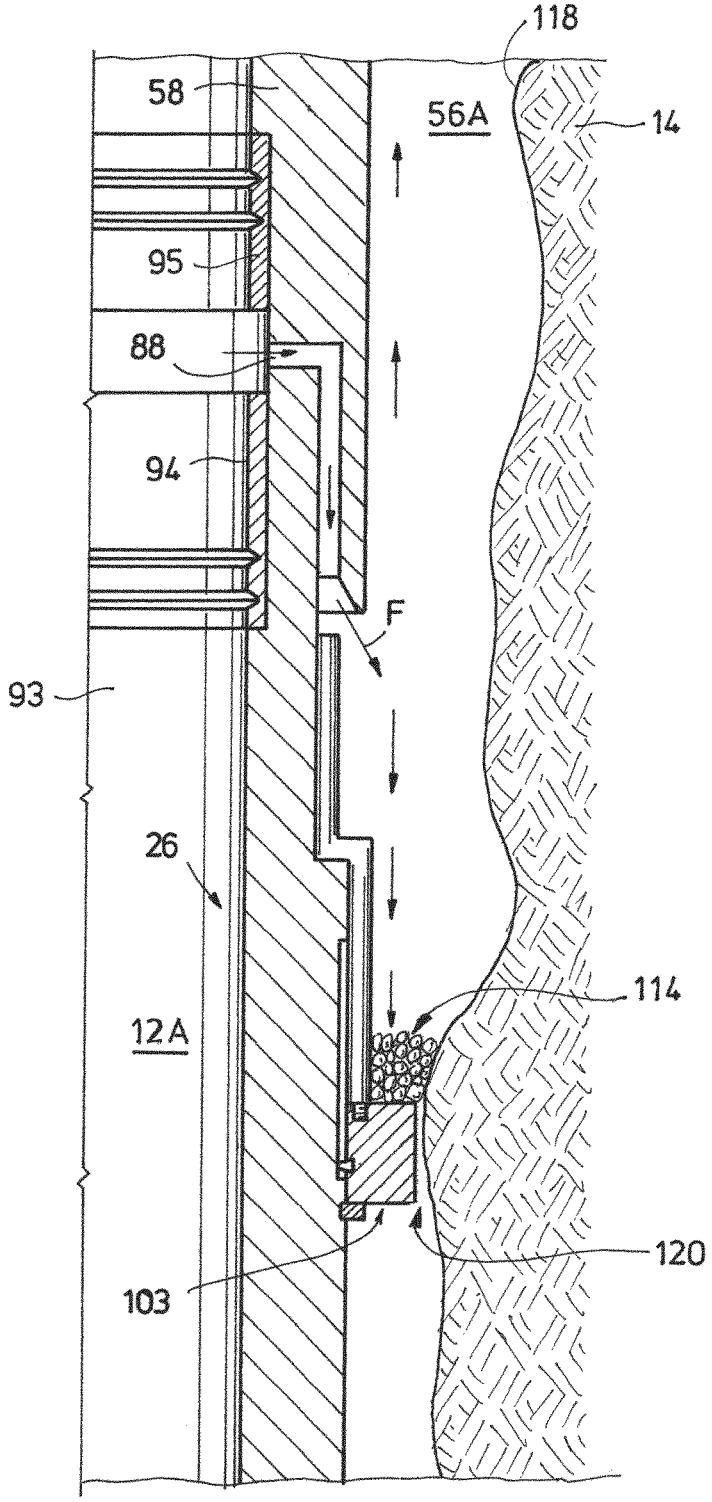
FIGS. 8A and 8B are side sectional views of an example of a stage cementing sequence using the cement sleeve of FIG. 4A and in an uncased wellbore.
Figure 8B:
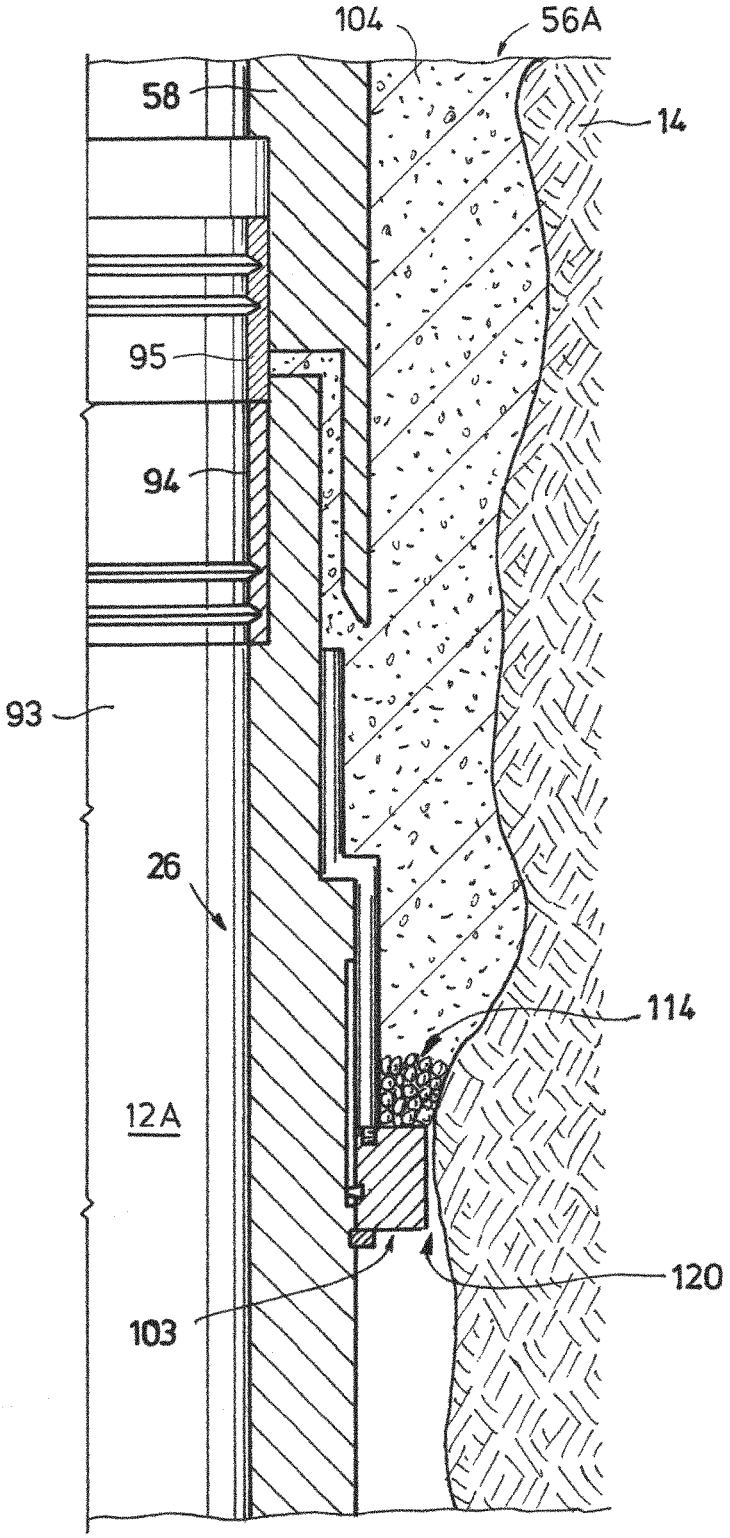

Another alternate embodiment of cementing is shown in FIGS. 8A and 8B, where the cementing sleeve 26 is disposed within an open hole wellbore 12A. In this example, a sidewall 118 of wellbore 12A is not straight, but instead is shown having undulations. Further, portions of the formation 14 adjacent sidewall 118 can have high permeability that might be prone to forming a lost circulation zone so that in an overbalanced situation fluids in the wellbore could migrate into the formation 14. Here also, lost circulation material 114 is disposed with fluid F in which covers a gap 120 that can form between the outer radial surface of seal 103 and sidewall 118. Thus, as shown in FIG. 8B, the cement 104 can fill the annulus 56A between the housing 58 and formation 14 cannot seep through the space 120.

FIG. 9 shows in side sectional view how ends of the cementing sleeve 26 may be attached to the casing 24. More specifically, a pin end 122 of sleeve 26 engages a box end of casing 24 and has threads 124 to engage the box end. Similarly, a box end 126 of sleeve 26 mounts to an end of sleeve 26 distal from pin end 124 and threadingly receives casing 24 and is engaged thereto with threads 128 formed on an inner surface of box end 126.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for use with operations in a wellbore comprising:

a cementing sleeve having axial ends that selectively attach to tubulars;

a stationary block mounted to an outer surface of the cementing sleeve and that circumscribes a portion of an outer periphery of the cementing sleeve;

a space on the outer periphery of the cementing sleeve that is defined between circumferential ends of the stationary block; and a sliding block on the outer surface of the cementing sleeve and that is selectively moveable into the space from a location spaced axially away from the space to substantially fill the space and form a seal along the outer periphery of the cementing sleeve.

2. The system f claim 1, further comprising a passage formed radially through the cementing sleeve and that is in selective communication with the outer surface of the cementing sleeve when the sliding block is moved into the space.

3. The system of claim 2, further comprising an opening sleeve on an inner surface of the sleeve and that is axially moveable from an interfering position adjacent where the passage intersects with an inner surface of the cementing sleeve to an open position that is axially set away from where the passage intersects with the inner surface, so that fluid inside of the cementing sleeve is in communication to the outer surface of the cementing sleeve through the passage.

4. The system of claim 3, further comprising a closing sleeve that is axially moveable from a position adjacent the opening sleeve when the opening sleeve is in the interfering position, to a closing position that is adjacent the passage intersects with the inner surface of the cementing sleeve.

5. The system of claim 3, further comprising a drill bit selectively attached to the wellbore string and that is used to form the wellbore.

6. The system of claim 1, wherein the tubulars comprise wellbore casing, and wherein the combination of the wellbore casing and cementing sleeve comprises a wellbore string.

7. The system of claim 1, further comprising an elongated arm attached to the sliding block and having an end inserted into a portion of the passage adjacent an outer surface of the cementing sleeve, so that when pressure inside of the cementing sleeve is increased, a force from the increased pressure is exerted onto the end of the arm in the passage to move the arm and the sliding block into the space.

8. The system of claim 7, wherein the elongated arm comprises a lower section, a middle section, and an upper section, wherein the lower section attaches to the sliding block and the upper section inserts into the passage, wherein the middle section joins the upper and lower sections, wherein the upper and lower sections extend generally parallel with an axis of the cementing sleeve, and wherein the middle section extends generally perpendicular to the axis of the cementing sleeve.

9. The system of claim 1, further comprising a multiplicity of cementing sleeves.

10. A system for use with operations in a wellbore comprising:

a cementing sleeve having axial ends that selectively attach to tubulars;

stationary blocks mounted to an outer surface of the cementing sleeve spaced angularly apart from one another, and that each circumscribe separate portions of an outer periphery of the cementing sleeve;

spaces on the outer periphery of the cementing sleeve defined between opposing ends of adjacent stationary blocks; and sliding blocks spaced angularly apart from one another on the outer surface of the cementing sleeve, and that are selectively moveable into the spaced from locations set axially away from the spaces to substantially fill the spaces and form a seal along the outer periphery of the cementing sleeve.

11. A method of performing operations in a wellbore comprising:

a. aligning blocks along an outer circumference of a cementing sleeve in the wellbore to form a seal between the cementing sleeve and an inner surface of the wellbore;

b. supplying wellbore cement into a bore of the cementing sleeve; and c. diverting the cement from the bore into an annulus and adjacent the seal, so that the cement flows in the annulus in a direction away from the seal.

12. The method of claim 11, wherein the cementing sleeve has opposing axial ends attached to wellbore casing, wherein the cementing sleeve and wellbore casing comprise a casing string.

13. The method of claim 12, further comprising inserting the casing string into the wellbore and rotating the casing string in the wellbore.

14. The method of claim 12, wherein a drill bit is provided on an end of the casing string, the method further comprising forming the wellbore by rotating the drill bit and casing string.

15. The method of claim 11, wherein the cementing sleeve comprises a first cementing sleeve, the method further comprising repeating steps (a)-(c) with a second cementing sleeve that is at a depth in the wellbore that is different than a depth of the first cementing sleeve.

16. The method of claim 11, further comprising filling a space between an outer periphery of the seal and the inner surface of the wellbore by providing lost circulation material into the bore and diverting the lost circulation material into the annulus.

17. The method of claim 11, wherein the blocks comprise sliding blocks and stationary blocks, wherein spaces are defined between ends of the stationary blocks that face an adjacent stationary block, and wherein arms are attached to the sliding blocks that have ends selectively insertable into passages that penetrate through sidewalls of the cementing sleeve.

18. The method of claim 17, wherein the step of aligning the blocks comprises increasing a pressure in the bore so that a force applied to the arms urges the arms axially along an outer surface of the cementing sleeve and pushes the sliding blocks into the spaces.

19. The method of claim 11, further comprising moving opening and closing sleeves disposed coaxially inside the bore to selectively control fluid communication between the bore and outer surface of the cementing sleeve.

20. The method of claim 19, wherein the opening and closing sleeves are moved by engaging the opening and closing sleeves with a tubing string and axially moving the tubing string inside of the bore.

* * * * *